US005235726A

United States Patent [19]

Geier, Jr. et al.

[11] Patent Number: 5,235,726

[45] Date of Patent: Aug. 17, 1993

[54] COMPRESSION DOOR HINGE FOR A MOTORIZED VEHICLE

[75] Inventors: Rudy J. Geier, Jr.; Ariel Caliwliw; Christopher J. Kowalsky, all of Windsor, Canada

[73] Assignee: HSL Limited, Tecumseh, Canada

[21] Appl. No.: 723,060

[22] Filed: Jun. 28, 1991

[51] Int. Cl.[5] ..... E05D 11/10

[52] U.S. Cl. ..... 16/334; 16/322; 16/277; 16/DIG. 36

[58] Field of Search ..... 16/277, 297, 298, 319, 16/321, 334, 335, 308, 322, 336, 344, 345-347, 278, DIG. 38; 403/84

[56] References Cited

U.S. PATENT DOCUMENTS

| | | | |
|---|---|---|---|
| 1,564,611 | 12/1925 | Mountford et al. | 16/322 |
| 3,070,829 | 1/1963 | Peras | 16/319 |
| 3,370,317 | 2/1968 | Marchione | 16/308 |
| 3,371,374 | 3/1968 | Marchione | 16/334 |
| 3,911,529 | 10/1975 | Pringle | 16/335 |
| 4,285,098 | 8/1981 | Hicks et al. | 16/308 |
| 4,720,895 | 1/1988 | Peebles | 16/264 |
| 4,807,331 | 2/1989 | Calucci | 16/262 |
| 4,815,164 | 3/1989 | Rottingham | 16/347 |
| 4,864,687 | 9/1989 | Calcaterra et al. | 16/334 |
| 4,932,101 | 6/1990 | Lualdi | 16/347 |

FOREIGN PATENT DOCUMENTS

| | | | |
|---|---|---|---|
| 1279506 | 10/1968 | Fed. Rep. of Germany | 16/335 |
| 467525 | 6/1937 | United Kingdom | 16/337 |

*Primary Examiner*—John Sipos
*Assistant Examiner*—Donald M. Gurley
*Attorney, Agent, or Firm*—Harness, Dickey & Pierce

[57] ABSTRACT

This invention discloses a hinge for use in a door of a motorized vehicle. The hinge includes a first part rigidly connected to a frame of the vehicle and a second part rigidly connected to the door. The first and second parts of the hinge are both connected to a hinge pin which enables the second part to be rotatable relative to the first part upon opening and closing of the door. A compressible spring mechanism is rigidly connected to the first part and engagable against the second such that upon swinging of the door the spring is compressed. The second part includes two wheels such that the spring mechanism engages one of the wheels when the door is closed, it engages both of the wheels in a door position when the door is partially open, and engages the other detent wheel when the door is fully open.

21 Claims, 5 Drawing Sheets

COMPRESSION DOOR HINGE FOR A MOTORIZED VEHICLE

BACKGROUND OF THE INVENTION

1. Field of the Invention

This invention relates generally to a door hinge, and more particularly, to a door hinge incorporating a compression spring for use in a motorized vehicle.

2. Discussion of the Related Art

It is known in the art to incorporate door hinges in a motorized passenger vehicle or the like for facilitating opening and closing of the vehicle's doors. Typically, each door will incorporate two door hinges positioned at an upper and lower location of the door. The door hinge will generally have a first part which is rigidly connected to the frame of the vehicle, and a second part which is rigidly connected to the door. The second part is movable relative to the first part so as to enable the door to swing from a closed position to an open position, and vice-versa.

Typically, automotive door assemblies include a detent mechanism which permits the door to remain in an open position and/or a partially open position against a spring force without applying outside, additional forces. In some designs, these detent mechanisms have been incorporated as part of one of the door hinge. Conventional door hinges of this type often make use of torsional forces exerted on a spring mechanism to produce resistance against movement of the second part of the hinge, and thus prevent undesirable swinging of the door and/or enable the door to gently swing back to a closed position.

Conventional door hinges which use torsional springs often suffer from a number of disadvantages. First, the torsional forces placed on the spring mechanism may cause relatively early failure of the spring after a relatively low number of door swing repetitions due to the torsional loading of the spring. Secondly, the torsional spring design is often application specific in that different diametered spring mechanisms are required for hinges accommodating doors of different sizes and masses. This requires the use of relatively large inventory of spring mechanisms to accommodate different door designs. Thirdly, the torsional spring design is relatively large thus producing a number of problems concerning space limitations and excessive weight.

What is needed then is a compact, lightweight, compressional type door hinge which is adaptable to different resistive forces without changing the spring mechanism. It is therefore an object of the present invention to provide such a door hinge.

SUMMARY OF THE INVENTION

This invention describes a door hinge which includes a spring element arranged in a compressional configuration. A first part of the door hinge is rigidly affixed to the frame of a motorized vehicle or the like, and a second part of the door hinge is rigidly affixed to a door of the vehicle. The first part and second part are connected by means of a hinge pin. Upon movement of the door relative to the vehicle's frame, the second part rotates about the hinge pin thereby allowing the door to swing between an open and closed position. The compressional spring element is rigidly connected to the first part and engages a detent mechanism associated with the second part, and thus provides a resistance force to opening the door. The detent mechanism maintains the door in an open position at two or more locations against the spring force. These locations are typically fully open and partially open, the partially open position being adjustable to different locations by adjusting the parameters of the detent mechanism. In one embodiment, the detent mechanism is comprised of two configurated roller wheels positioned on parallel axes, such that the spring element rests against one of the wheels in a closed position, both of the wheels in a partially open position, and the other wheel in a fully opened position.

The design as discussed above enables the hinge to be more compact in nature, thus reducing its weight and enabling the door to be opened wider over the prior art door hinges. The resistance of the spring can be changed by adjusting the location at which the spring engages the first part of the hinge. Consequently, the door hinge can be incorporated into a variety of different sized doors without replacing the spring with a larger or smaller spring. The roller wheel detent design provides an integrated detent in the door hinge which eliminates the need to have a separate detent in the door. Moreover, the detent design is readily adjustable to incorporate different positions in which the door can be maintained open. Consequently, the overall design of the door hinge, according to one preferred embodiment of the present invention, includes a compact, lightweight door hinge exhibiting long life and capable of being easily formed.

Additional objects, advantages, and features of the present invention will become from the following description and appended claims, taken in conjunction with the accompanying drawings.

DETAILED DESCRIPTION OF THE PREFERRED EMBODIMENTS

The following description of the preferred embodiments of the present invention is merely exemplary in nature and is in no way intended to limit the invention or its applications or uses.

Figure 1:
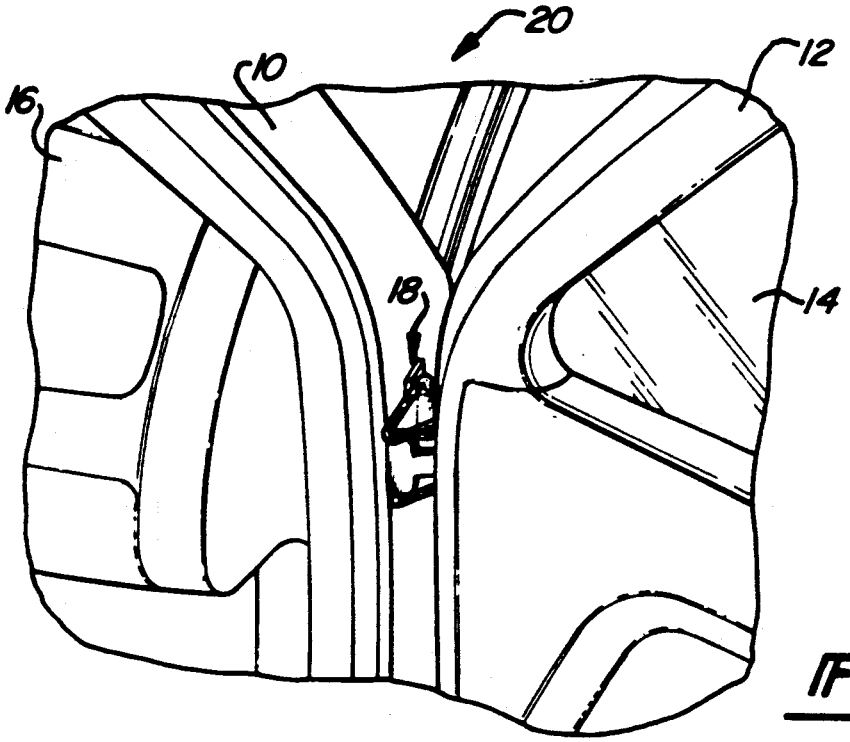
FIG. 1 is a partial, perspective view of a motorized vehicle incorporating a door hinge according to a first preferred embodiment of the present invention.

FIG. 1 shows the environment in which a compression-type door hinge, according to a first preferred embodiment of the invention, may be used. Shown is a vehicle frame 10 which is used to support a vehicle door 12 which includes a window 14. To permit the vehicle door 12 to move in a direction opposite of the dashboard 16, a compression-type door hinge 18 is provided. The door hinge 18 is rigidly positioned between the frame 10 of the vehicle 20 (only part of which is shown) and the door 12. As is apparent by the configuration of the door 12 and the window 14 relative to the dashboard 16, the door 12 is a passenger door of an automobile. By this description it is further apparent that the door hinge 18 is positioned at an upper location of the door 12 between the door frame 10 and the door 12. As will be described below, the door hinge 18 enables the door 12 to be opened against a resistive spring force and to be positioned at rest in a completely open position (as shown), and in a partially open position between the completely open position and the closed position. Typically, the door hinge 18 will be formed completely of metal and may be produced either by rolling or stamping.

Figure 2:
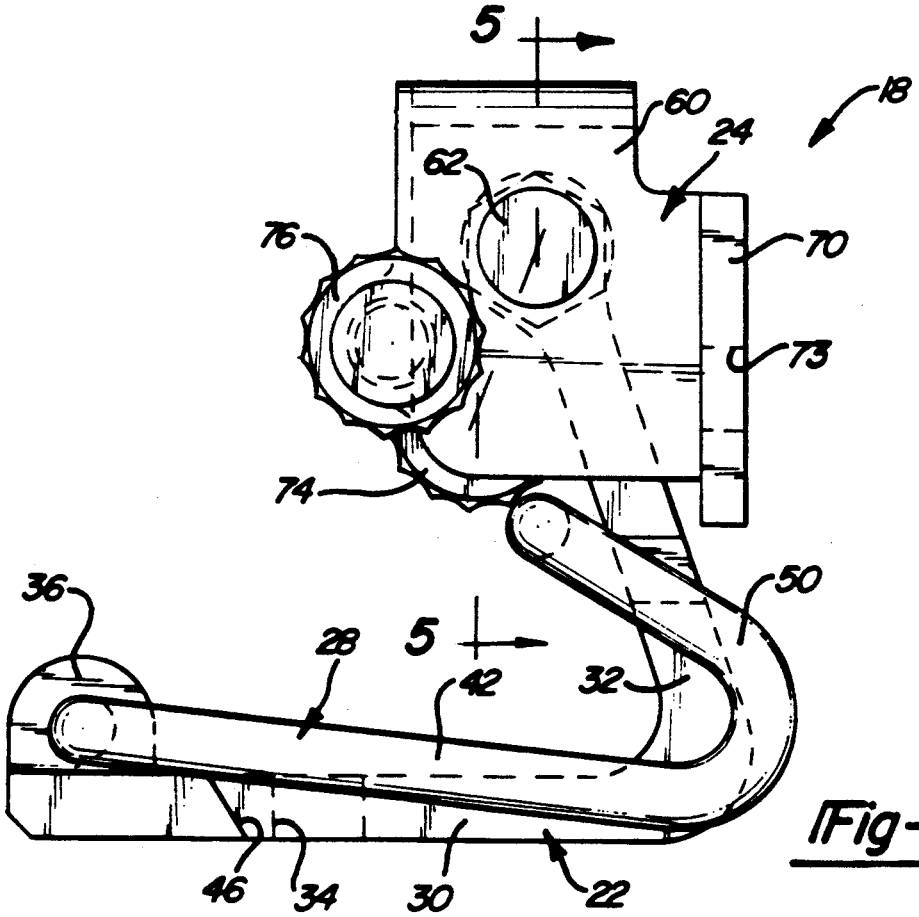
FIG. 2 is a side view of the door hinge of FIG. 1 according to the first preferred embodiment of the present invention taken as if the door were in a closed position.
Figure 3:
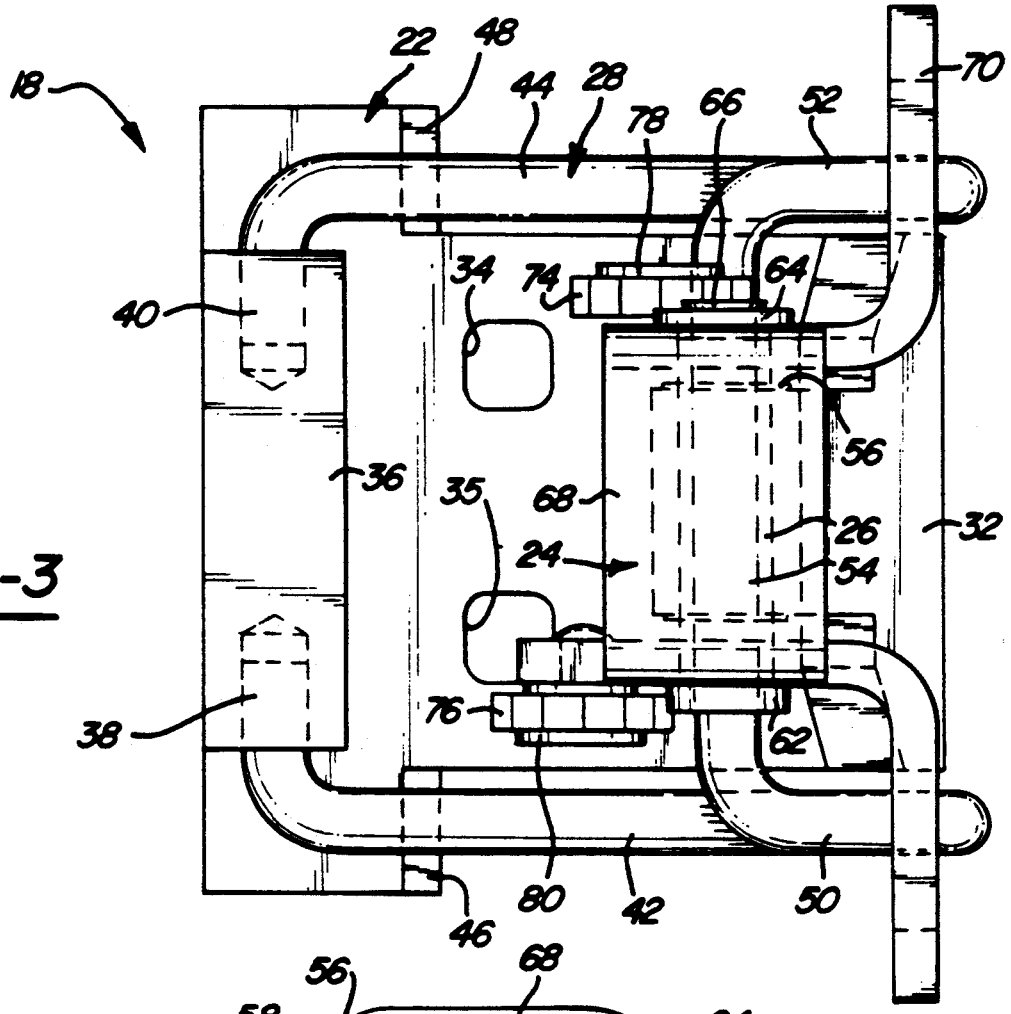
FIG. 3 is a top view of the door hinge of FIG. 1 according to the first preferred embodiment of the present invention taken as if the door were in a closed position.
Figure 4:
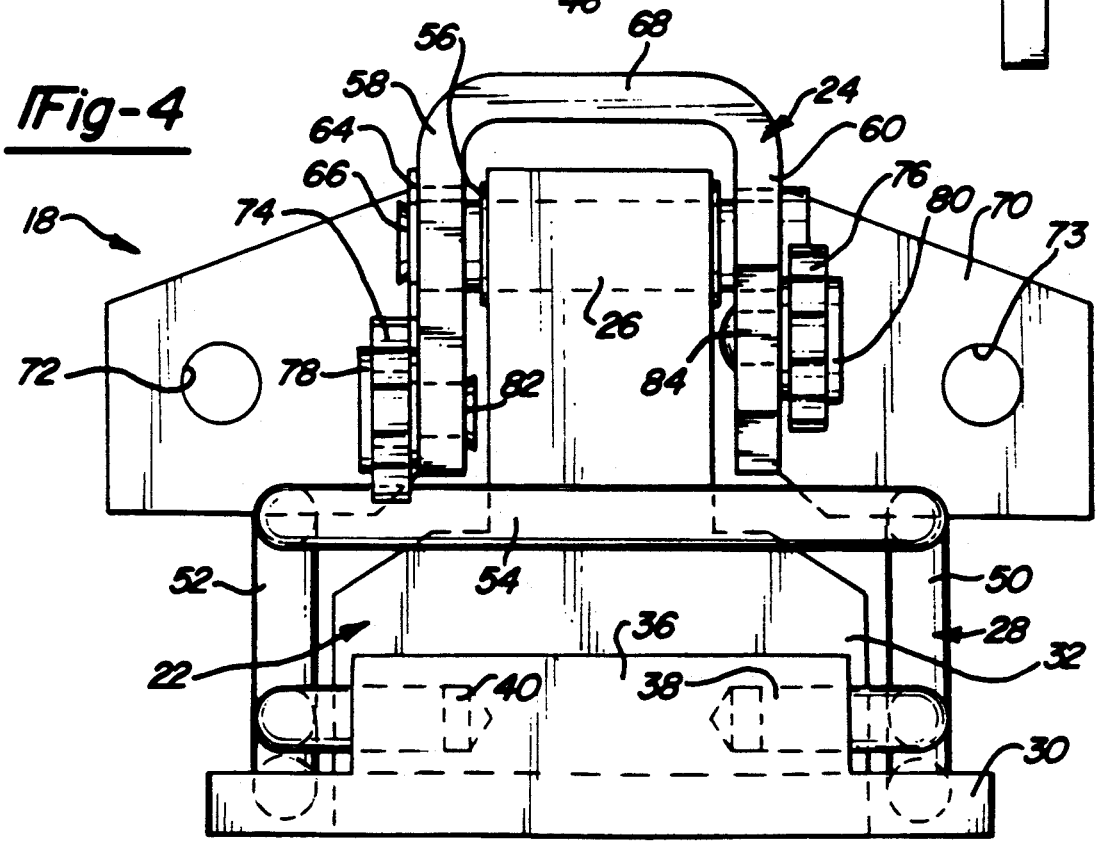
FIG. 4 is an end view of the door hinge of FIG. 1 according to the first preferred embodiment of the present invention taken as if the door were in a closed position.

Turning to FIGS. 2, 3 and 4, a basic understanding of the structural arrangement of the different components of the door hinge 18 which combine to form a novel door hinge can be ascertained. The door hinge 18 is comprised of a first part 22 and a second part 24 which are movable relative to each other. The first part 22 and the second part 24 are connected and positionable relative to each other by means of a metal hinge pin 26 acting as an axle. A compression spring 28 is rigidly affixed to the first part 22 and rests against the second part 24 such that the spring 28 is compressed by the second part 24 when the second part 24 is rotated on the hinge pin 26. The spring 28 is formed from a metal rod shaped in an appropriate configuration as will be described hereunder.

The first part 22 includes a flat base plate 30 and an extension arm 32. The base plate 30 includes holes 34 and 35 through which bolts can be inserted in order to secure the hinge 18 to the door frame 10 in an appropriate manner. Other means, such as welding, may be used to secure the hinge 18 to the frame 10. The arm 32 of the part 22 is formed at an end of the base plate 30 and angled away from it to engage the hinge pin 26. The arm 32 is rigidly attached to the hinge pin 26 by means of a bushing 56. In order to connect to the hinge pin 26 relative to the second part 24, the arm 32 is shaped in a tapered configuration (see FIG. 4).

Formed to the base plate 30 opposite to the arm 32 is a protruding structure 36 for engaging the spring 28. The opposite ends 38 and 40 of the compression spring 28 are rigidly affixed to the structure 36 by inserting the ends 38 and 40 into opposite ends of a bore running through structure 36, as shown. The ends 38 and 40 of the spring 28 are then bent at substantial 90° angles to form the sections 42 and 44 of the spring 28, respectively. The sections 42 and 44 of the spring 28 traverse substantially the entire length of the base plate 30 and ride against fulcrum lip portions 46 and 48, respectively, of the base plate 30 proximate to the structure 36 as shown. In this configuration, the base plate 30 is in a T-shape. When the sections 42 and 44 of the spring 28 pass the lip portions 46 and 48 from the support structure 36, they ride along the outside edges of the base plate 30. Once the sections 42 and 44 of the spring 28 reach the arm 32 of the first part 22, they are then bent in an upward and forward configuration to form sections 50 and 52 of the spring 28, respectively as shown. The sections 50 and 52 are then bent at substantially 90° angles towards each other to form a crossbar section 54 of the spring 28, as shown. The section 54 of the spring 28 engages the second part 24 of the hinge 18 as will be described hereunder.

The second part 24 is rotatable about the hinge pin 26 by being connected to the hinge pin 26 through the aligned holes in the side walls 58 and 60 of the second part 24. In addition, the upper tapered end of the arm 32 is disposed between the side walls 58 and 60. The second part 24 is held in place in a rotatable configuration on the hinge pin 26 by means of a hinge pin head 62, a hex washer 64, and a rotary peen 66 (see FIG. 5 and related discussion below), in a manner as is well-known in the art. In this manner, the second part 24 is free to rotate about the hinge pin 26 upon application of an appropriate force. A top portion 68 of the part 24 connects the side walls 58 and 60 above the hinge pin 26 as shown. Also connected and perpendicular to the side walls 58 and 60 is a support section 70 for rigidly affixing the second part 24 to the vehicle door 12. The support section 70 extends beyond the side walls 58 and 60 (see FIG. 4) to provide a wide support base when connected to the door 12. In the design as shown in FIGS. 2–4, the section 70 is engaged with the door 12 by means of bolts through the bores 72 and 73 of the section 70. However, other means, such as welding, can be used to rigidly attach the section 70 to the door 12.

Disposed adjacent to the side walls 58 and 60 are two configurated rollers 74 and 76, respectively. The configurated rollers 74 and 76 are appropriately offset on parallel axes from each other to provide a door detent position as will be described hereunder. The roller 74 is secured to an outside surface of the side wall 58 by means of a knurled pin 78 which traverses both the roller 74 and the side wall 58. The pin 78 includes a head portion positioned flush against an outside surface of the roller 74 and is secured at a inside surface of the side wall 58 by means of a securing device 82. The knurled portion of the pin 78 is positioned within the hole in the side wall 58. Likewise, the roller 76 is secured to an outside surface of the side wall 60 by means of a knurled pin 80 which traverses both the roller 76 and the side wall 60. A securing device 84 maintains the pin 80 connected to the side wall 60 on an inside surface location, as shown. In this configuration, one or both of rollers 74 and 76 engage the section 54 of the spring 28 depending on what location the second part 24 is in relative to the first part 22, as will be described hereunder.

Figure 5:
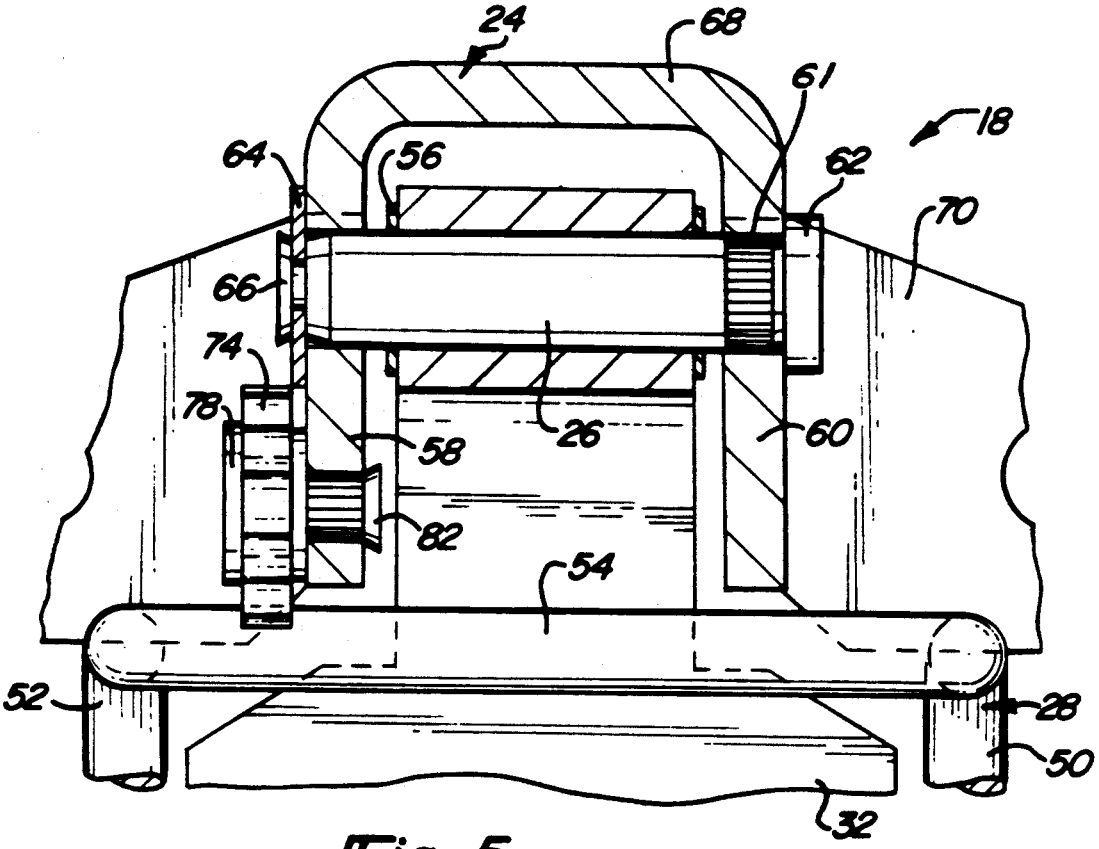
FIG. 5 is a cut-away view of the door hinge of FIG. 2 according to the first preferred embodiment of the present invention taken along lines 5—5.

FIG. 5 is a sectional view taken along lines 5—5 of FIG. 2 to more fully show the arrangement of the hinge pin 26. As discussed above, the hinge pin 26 is disposed through the arm 32 at an end opposite to the base plate 30 in a rigid configuration by means of the bushing 56. The hinge pin 26 extends through holes in the side walls 58 and 60 adjacent the arm 32. The ends of the hinge pin 26 are substantially flush with the outside surface of the side walls 58 and 60. An end 61 of the hinge pin 26 is knurled to provide a resistive force to the part 24 being rotated on the hinge pin 26. The hinge pin 62, the washer 64 and the rotary peen 66 maintain the hinge pin 26 in a fixed location within the aligned holes through the side walls 58 and 60 in a manner in which the second part 24 will turn about the hinge pin 26.

Also shown rigidly affixed to the side wall 58 is the roller 74. The roller 74 is rigidly held in place in the wall 58 by means of the knurled pin 78 having the securing device 82 on an inner surface of the side wall 58. In this configuration, the roller 74 is not rotatable. The crossbar section 54 of the spring 28 is shown engaged in a groove of the roller 74. In FIG. 5, as with FIGS. 2–4, the door 12 would be in a closed position. As will be discussed below, as the door 12 is opened, the second portion 24 is rotated about the hinge pin 26 which forces the spring 28 to compress.

Figure 6A:
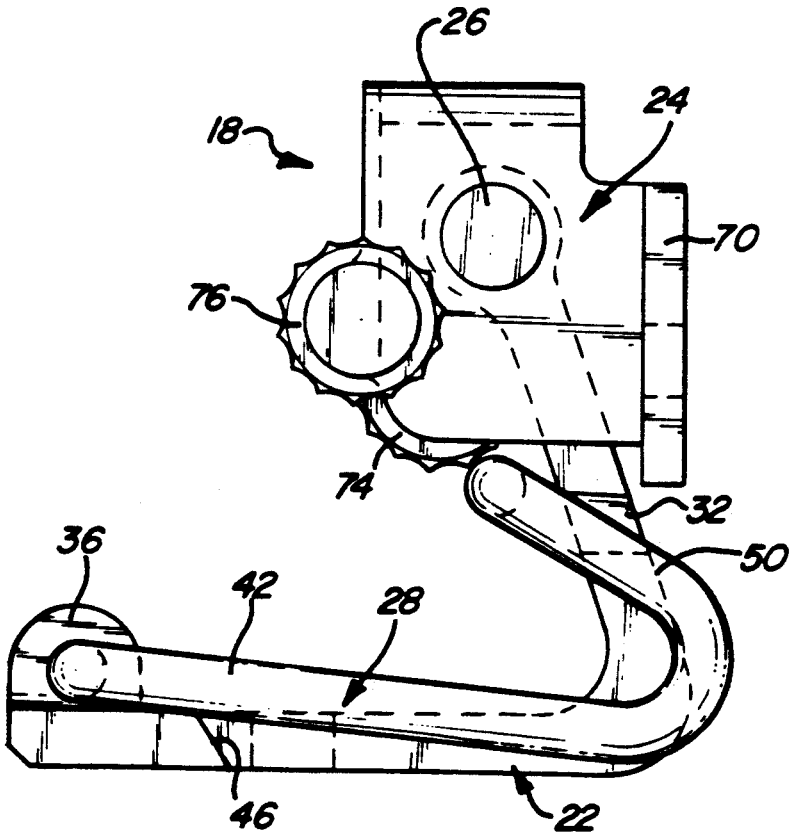
FIGS. 6(*a*)–6(*c*) are side views of the door hinge of FIG. 1 according to the first preferred embodiment of the present invention taken as if the door were in a closed position, a partially open position and a completely open position, respectively.
Figure 6B:
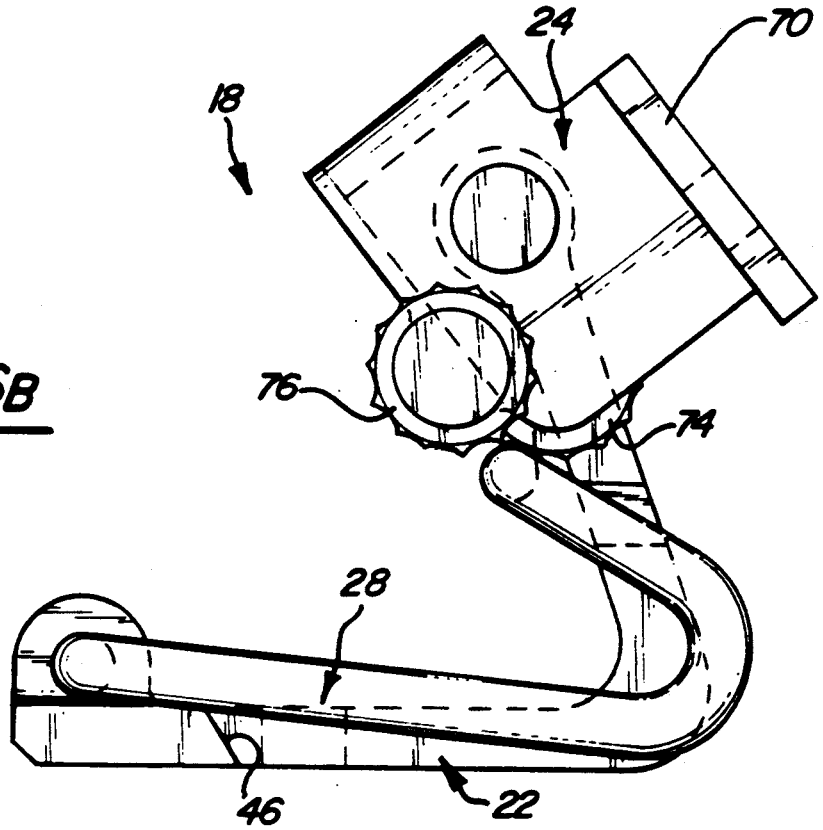
Figure 6C:
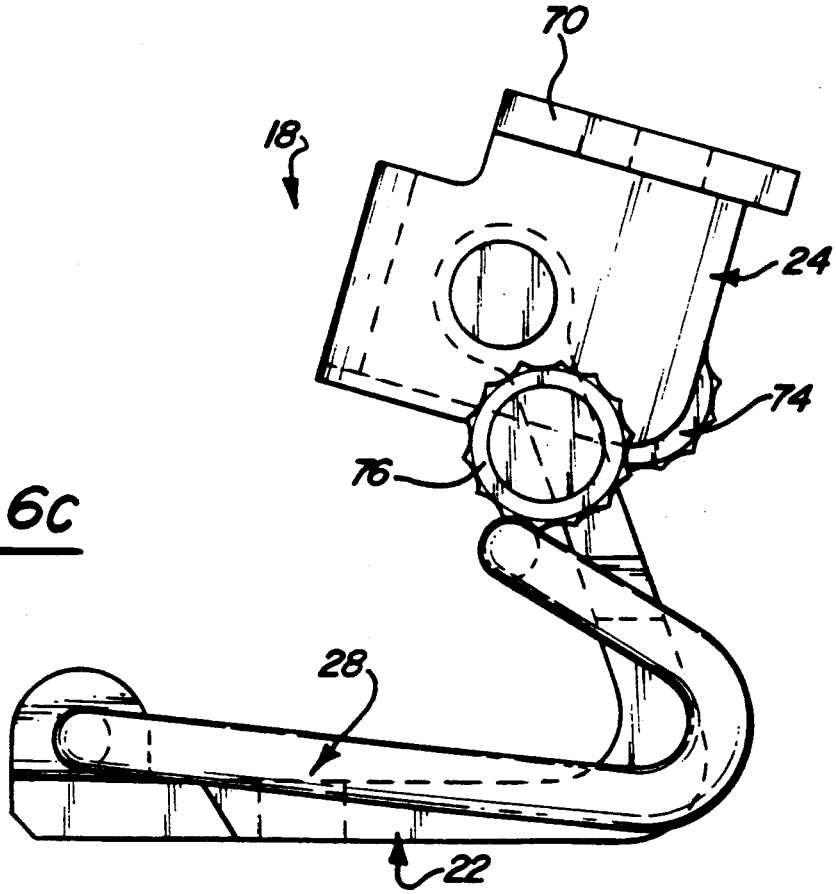

To more fully understand the operation of the door hinge 18, it is advantageous to view FIGS. 6(*a*)–6(*c*) in unison. FIG. 6(*a*) is substantially identical to FIG. 2. Therefore, an independent review of the different structural components of FIG. 2 may be in order. In a door closed position, the crossbar 54 of the spring 28 rests against a groove of the roller 74, as shown. The door 12 is rigidly bolted to the support section 70 of the second part 24. As the door 12 is opened, the second part 24 is rotated counter-clockwise about the hinge pin 26. As the part 24 rotates, the roller 74 is forced down against the crossbar 54 of the spring 28 forcing it into compression. The spring force is therefore a force opposing the opening of the door. The compression of the spring 28 takes place at the joining place of the sections 42 and 50 and the sections 44 and 52. In addition, the section 42 of the spring 28 is forced against the lip portion 46 and the section 44 of the spring 28 is forced against the lip portion 48, both of the base plate 30.

As the door 12 is continually opened, it will eventually reach a detent position, as shown in FIG. 6(*b*). In this position, the crossbar 54 of the spring 28 is in contact with both the rollers 74 and 76. Consequently, the door 12 will be locked in a rest location, unable to return to a closed position under the compression force of the spring 28. In other words, the spring 28 will not force the door out of the detent position and thus it will remain in this position without any intervening forces. However, under additional force by an operator, the door 12 can be moved out of the detent position to a fully open position as shown in FIG. 6(*c*). In this position, the crossbar 54 of the spring 28 rests against a groove of the roller 76, instead of the roller 74 as with the door closed representation of FIG. 6(*a*).

In all of the closed, detent, and open positions, the spring 28 is under little or no compression making the door able to remain in these positions. As the door 12 travels from the closed position to the detent position and from the detent position to the fully open position, or vice-versa, the spring 28 is in compression forcing it to return to the more closed of the three positions. It is noted that the rollers 74 and 76 can be redesigned such that they are positioned on different axes relative to each other, have different diameters, and/or a different groove configuration such that the detent position of FIG. 6(B) is different, making the door position different.

Figure 7:
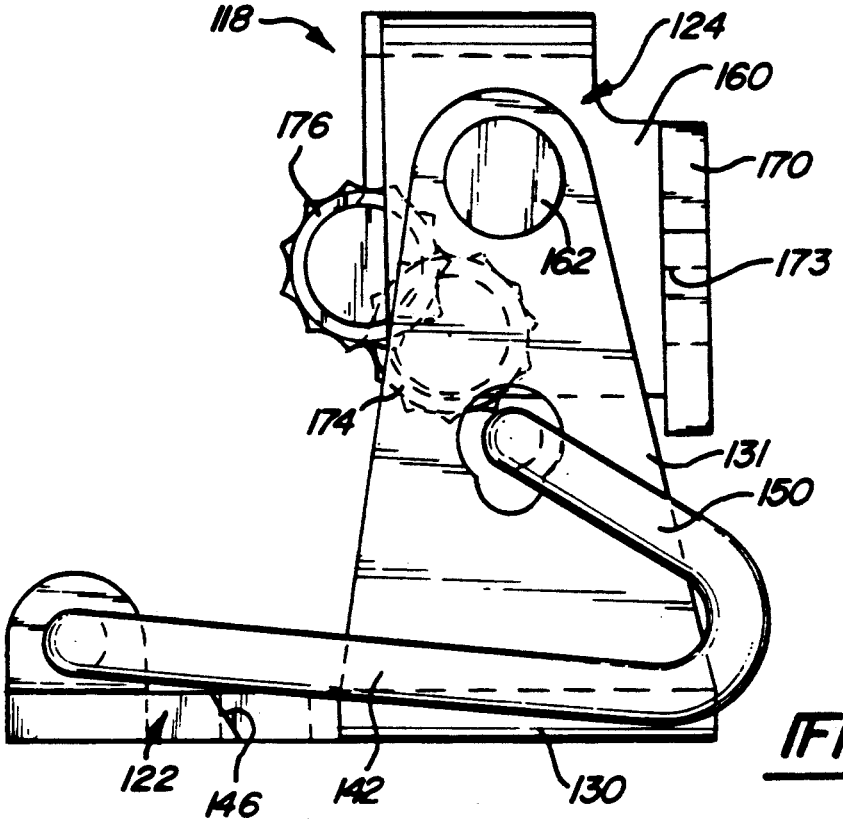
FIG. 7 is a side view of a door hinge according to a second preferred embodiment of the present invention.
Figure 8:
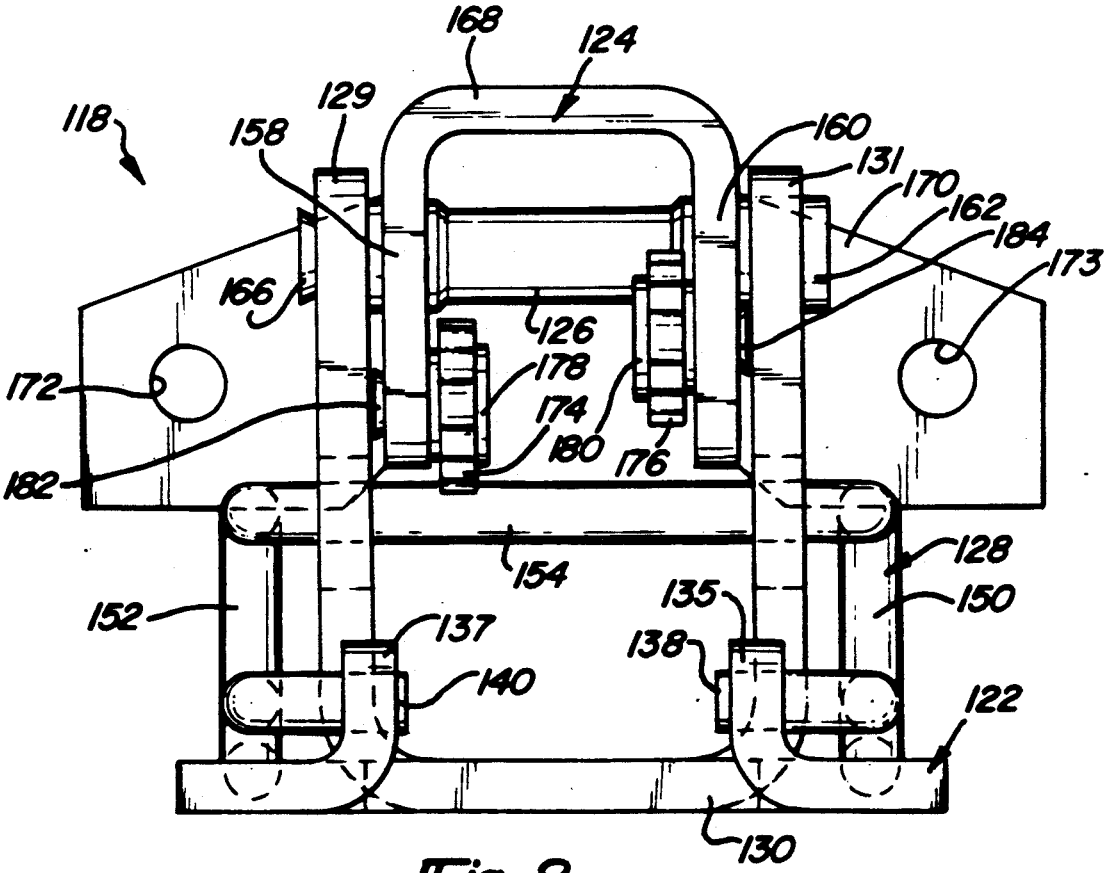
FIG. 8 is a front view of the door hinge of FIG. 7 according to the second preferred embodiment of the present invention.

The above-described design offers a number of advantages not found in the prior art. Specifically, the hinge 18 operates on a compressional force under the spring 28, as opposed to the more conventional torsional force springs of the prior art. Consequently, the life of the hinge can be extended since a torsional force generally leads to premature failure of the hinge. Also, the same spring 28 is operable to be used with a wide range of different sized and weighted doors. Instead of adjusting the spring diameter to adjust the spring compression, it is merely necessary to redefine the position of the fulcrum lip portions 46 and 48 as engaged against the sections 42 and 44, respectively of the spring 28 to change the spring resistance. This is a simple step in the manufacturing of the hinge. In addition, the shape of the spring 28 makes the hinge more compact. This is advantageous for a number of reasons, specifically, space limitations in the door are crucial because of the requirements of certain electrical connections between the door and the vehicle. Further, a more compact design decreases the weight of the device, thus increasing the mileage of the vehicle. The weight of the hinge according to this invention is approximately 1.7 lbs., whereas a conventional hinge may weigh 2.5 lbs. Moreover, a smaller hinge enables the door to be opened wider. The first preferred embodiment as discussed above, describes a hinge which is applicable to be roll formed when manufactured. This causes the hinge 18 to have relatively high inherent strength which improves performance during sag and deflection testing. It is further possible to manufacture a hinge within the scope of this invention which is stamp formed. FIGS. 7 and 8 represents a hinge defining a second preferred embodiment of the invention which is applicable to be stamp formed and which is similar in most respects to that of the first preferred embodiment discussed above. In this embodiment, like parts to those discussed above will have the same reference numeral with a "1" in front of them.

Turning to FIGS. 7 and 8, a hinge 118 according to the second preferred embodiment is shown. In this embodiment, the protruding structure 36 of the first preferred embodiment for supporting the ends 38 and 40 of the spring 28 has been replaced with the upright tabs 135 and 137 for rigidly positioning the spring ends 138 and 140 respectively, as shown. Each of the tabs 135 and 137 has a bore through them for accommodating the ends 138 and 140 in a rigid configuration. The area between the tabs 135 and 137 is generally left open, thus reducing the weight of the hinge.

A further distinction is the replacement of the arm 32 with the dual upright arms 129 and 131. In this embodiment, the arms 129 and 131 of the first part 122 are connected to the base plate 130 along the edges of the base plate 130 at an end opposite to the tabs 135 and 137, and are connected to the hinge pin 126 adjacent outside surfaces of the side sections 158 and 160 of the second part 124. Consequently, the ends of the hinge pin 126 are positioned within aligned holes through the arms 129 and 131, since the second part 124 is now on the inside. Also, the crossbar section 154 of the spring 128 traverses a second pair of aligned holes through the arms 129 and 131, as shown. In this arrangement, therefore, no room is available on the outside surfaces of the side walls 158 and 160 for the rollers 174 and 176. Accordingly, the rollers 174 and 176 are positioned on the inside surfaces of the side walls 158 and 160, respectively, as shown in the same manner as the first preferred embodiment. Other than that, the remaining components are substantially the same as with the first preferred embodiment. In addition, the operation of the hinge 118 is substantially identical t that of the hinge 18.

The foregoing discussion discloses and describes merely exemplary embodiments of the present invention. For example, the hinge may typically be used at the upper position of the door with another hinge without a detent mechanism being located at the lower position. However, the hinge of the present invention may also be used at the lower position as well. One skilled in the art will readily recognize from such discussion, and from the accompanying drawings and claims, that various changes, modifications and variations can be made therein without departing from the spirit and scope of the invention as defined in the following claims.

What is claimed is:

1. A hinge for use in opening and closing a door of an associated vehicle, said hinge comprising:

a first part configured to be rigidly connected to a frame of said vehicle, said first part having a base plate with first and second sides, said base plate further having separate fulcrum lip portions disposed on said first and second sides;

a spring mechanism rigidly connected to said first part;

a second part configured to be rigidly connected to said door of said vehicle, said second part contacting and exerting a compressive force on said spring mechanism as said door is opened or closed, said spring mechanism including a convoluted metal rod having parallel sections running along the first and second sides of said base plate of said first part overlaying and engaging said separate fulcrum lip portions for determining in part the magnitude of the compressive force exerted on said spring mechanism by said second part;

an axle connected to both said first part and said second part wherein said second part rotates on said axle relative to said first part upon opening and closing of said door.

2. The hinge according to claim 1 wherein said second part includes two rotary detent mechanisms, said rotary detent mechanisms rigidly connected to said second part and engagable against said spring mechanism such that one of said detent mechanisms engages said spring mechanism when the door is closed, both detent mechanisms engage said spring mechanism when said door is in a detent position and the other of said detent mechanisms engages said spring mechanism when said door is fully open.

3. The hinge according to claim 1 wherein said spring mechanism is a convoluted metal rod having a first end and a second end being rigidly connected proximate one end of a base plate of said first part, said rod being bent substantially 90° proximate the first and second ends of the rod such that a section adjacent both of the first and second ends of said metal rod travels a predetermined distance along said first and second sides of the base plate, said metal rod then being bent in an upward configuration away from the base plate toward said second part and back toward the first and second ends to a position generally overlaying the section of said metal rod extending along the first and second sides of the base plate, said metal rod then being bent perpendicular to the sections of the metal rod extending along said base plate to combine and form a section of said spring mechanism in contact with said second part.

4. The hinge according to claim 2 wherein each of said detent mechanisms are positioned on outside surfaces of opposing side walls of the second part.

5. The hinge according to claim 2 wherein each of said detent mechanisms are positioned on inner surfaces of opposing side walls of said second part.

6. The hinge according to claim 2 wherein said rotary detent mechanisms are aligned on parallel axes.

7. The hinge according to claim 1 wherein said first part includes an extension arm, wherein said spring mechanism is rigidly attached to one end of said base plate and said extension arm is formed at an opposite end of said base plate and extends away from said base plate and is rigidly connected to said axle.

8. The hinge according to claim 7 wherein said spring mechanism is a specially shaped metal rod having a first end and a second end, said first end and said second end of said metal rod being rigidly connected within a bore of said base plate.

9. The hinge according to claim 7 wherein said spring mechanism is a specially shaped metal rod having a first end and a second end, said first end and said second end of said metal rod being rigidly connected within a bore of two tabs extending from an end of said base plate opposite to said extension arm.

10. The hinge according to claim 7 wherein said extension arm is two extension arms extending from opposite sides of said base plate and connected to said axle adjacent outside surfaces of opposing side walls of said second part, said axle extends through substantially aligned holes in each of the arms and the opposing side walls.

11. The hinge according to claim 10 wherein said second part includes two rotary detent mechanisms, said rotary detent mechanisms rigidly connected to inside surfaces of said opposing side walls opposite to the extension arms such that one of said detent mechanisms engages said spring mechanism when the door is closed, both detent mechanisms engage said spring mechanism when said door is in a detent position and the other of said detent mechanisms engages said spring mechanism when said door is fully open.

12. The hinge according to claim 7 wherein the extension arm is connected to the axle by means of a bushing, said axle extends through aligned holes within opposing side walls of said second part and said extension arm wherein said extension arm is disposed between said opposing side walls.

13. The hinge according to claim 12 wherein said second part includes two rotary detent mechanisms, said rotary detent mechanisms rigidly connected to outside surfaces of said opposing side walls such that one of said detent mechanisms engages said spring mechanisms when the door is closed, both detent mechanisms engage said spring mechanism when said door is in a detent position and the other of said detent mechanisms engages said spring mechanism when said door is fully open.

14. A door hinge comprising:

a first part including a base plate disposed to be rigidly connected to a frame;

a second part disposed to be rigidly connected to a door;

an axle connected to both said first part and said second part wherein said second part rotates on said axle relative to said first part upon opening and closing of said door; and a spring mechanism formed into a convoluted metal rod and being compressed by said second part upon opening and closing of said door, said spring mechanism including:

(a) first and second sections which extend generally adjacent to said base plate of said first part, (b) a third section extending in a direction away from said base plate and said first section of said spring mechanism towards said second part and back toward and overlaying said first section forming an acute angle with respect to said first section of said spring mechanism, (c) a fourth section extending in a direction away from said base plate and said second section of said spring mechanism towards said second part and back toward and overlaying said second section forming an acute angle with respect to said second section of said spring mechanism, said second part compressing said third and fourth sections of said spring mechanism in a direction towards said first and second sections of said spring mechanism respectively upon opening and closing of said door.

15. The hinge according to claim 14 wherein the sections of said metal rod which travel along said base plate engage lip portions on opposite sides of said base plate, said spring mechanism being forced against said lip portions upon rotation of said second part.

16. The hinge according to claim 14 wherein said second part includes two rotary detent mechanisms, said rotary detent mechanisms rigidly connected to said second part and engagable against said spring mechanism such that one of said detent mechanisms engages said spring mechanism when the door is closed, both detent mechanisms engage said spring mechanism when said door is in a detent position and the other of said detent mechanisms engages said spring mechanism when said door is fully open.

17. The hinge according to claim 16 wherein said second part includes two opposing side walls including aligned holes through which said axle extends, one of each of the rotary detent mechanisms being disposed on inside surfaces of each of the opposing side walls.

18. The hinge according to claim 16 wherein said second part includes two opposing side walls including aligned holes through which said axle extends, one of each of the rotary detent mechanisms being disposed on outside surfaces of each of the opposing side walls.

19. The hinge according to claim 18 wherein said first part includes an arm extending from said base plate and being connected to said axle at a location between said opposing side walls such that a bore through said arm is aligned with the holes in the side walls to accommodate said axle.

20. The hinge according to claim 17 wherein said first part includes two extension arms extending from the base plate and being connected to said axle adjacent outside surfaces of said opposing side walls such that aligned holes in the extension arms are aligned with the holes in the side walls to accommodate said axle.

21. A hinge for use in opening and closing a door of an associated vehicle, said hinge comprising:

a first part configured to be rigidly connected to a frame of said vehicle;

a second part configured to be rigidly connected to said door of said vehicle;

an axle connected to both said first part and said second part wherein said second part rotates on said axle relative to said first part upon opening and closing of said door; and a spring mechanism rigidly connected to said first part, said spring mechanism further engaging said second part such that upon opening or closing of the door said second part forces said spring mechanism is compressed, said spring mechanism including a convoluted metal rod being subject to compressive loading rather than torsional loading upon opening or closing said door, said convoluted metal rod including a first end and a second end being rigidly connected proximate one end of a base plate of said first part, said rod being bent substantially 90° proximate the first and second ends of the rod such that a section adjacent both of the first and second ends of said metal rod travels a predetermined distance along side edges of said base plate, said metal rod then being bent in an upward configuration away from the base plate toward said second part and back toward the first and second ends to a position generally overlaying the section of said metal rod extending along the side edges of said base plate, said metal rod then being bent perpendicular to the sections of the metal rod extending along said base plate to combine and form a section of said spring mechanism in engagement contact with said second part.

* * * * *